US009946280B2

(12) United States Patent
Meier

(10) Patent No.: US 9,946,280 B2
(45) Date of Patent: Apr. 17, 2018

(54) CURRENT OUTPUT STAGE HAVING AUTOMATIC ACTIVE-PASSIVE SWITCHING

(75) Inventor: Heinz-Wilhelm Meier, Kalletal (DE)

(73) Assignee: Phoenix Contact GMBH & Co. KG, Blomberg (DE)

( * ) Notice: Subject to any disclaimer, the term of this patent is extended or adjusted under 35 U.S.C. 154(b) by 481 days.

(21) Appl. No.: 13/879,368

(22) PCT Filed: Oct. 13, 2011

(86) PCT No.: PCT/EP2011/067871
§ 371 (c)(1),
(2), (4) Date: Aug. 29, 2013

(87) PCT Pub. No.: WO2012/049239
PCT Pub. Date: Apr. 19, 2012

(65) Prior Publication Data

US 2013/0328535 A1 Dec. 12, 2013

(30) Foreign Application Priority Data

Oct. 13, 2010 (DE) ..... 10 2010 038 152

(51) Int. Cl.
*G05F 1/56* (2006.01)
*G05F 1/618* (2006.01)

(52) U.S. Cl.
CPC ..... *G05F 1/561* (2013.01); *G05F 1/618* (2013.01)

(58) Field of Classification Search
CPC ..... H02M 3/158; G05F 1/561; G05F 1/46; G05F 3/242; G05F 1/56; G05F 1/618;
(Continued)

(56) References Cited

U.S. PATENT DOCUMENTS 4,367,022 A * 1/1983 Yamasaki ..... G03B 7/083 396/228
4,672,230 A * 6/1987 Spahn ..... H03K 17/945 307/116

(Continued)

FOREIGN PATENT DOCUMENTS

CN 101411929 4/2009
DE 3817078 11/1989

(Continued)

OTHER PUBLICATIONS

International Preliminary Report on Patentability received in International Patent Application No. PCT/EP2011/067871, filed on Oct. 13, 2011, dated Apr. 16, 2013.

(Continued)

*Primary Examiner* — Fred E Finch, III
*Assistant Examiner* — Lorena Bruner
(74) *Attorney, Agent, or Firm* — Knobbe, Martens, Olson & Bear, LLP

(57) ABSTRACT

The invention relates to a current output stage (100) comprising an input (IN), an output (OUT) for connecting to an input of a unit (200) to be supplied with current, a control stage (T1, T2, Z1), which sets the output current (Iout), and an energy supply stage (Uv;Uv,−Uv), which can provide energy for the output current (Iout). The current output stage (100) comprises a first transistor (T1), which controls the output current in a closed-loop in the passive operating mode, and the current output stage (100) contains a second transistor (T2; T2, T3), which controls the output current (Iout) in a closed-loop in the active operating mode, wherein the first transistor (T1) and the second transistor (T2; T2, T3) is controlled by a control stage OP1) in an open loop, and wherein in the active operating mode the energy supply
(Continued)

stage (Uv;Uv,−Uv) is controlled in an open loop such that same provides energy for the output current (Iout).

4 Claims, 3 Drawing Sheets

(58) Field of Classification Search
CPC ..... G05F 1/461; G05F 1/573; G05F 1/575; G05F 1/619; G05F 3/247
USPC ..... 323/357, 358, 271, 277, 312
See application file for complete search history.

(56) References Cited

U.S. PATENT DOCUMENTS

| | | | | |
|---|---|---|---|---|
| 4,714,900 | A | 12/1987 | Sata | |
| 6,014,060 | A * | 1/2000 | Nojiri | H03F 1/0244 330/297 |
| 6,268,587 | B1 * | 7/2001 | Kooken et al. | 219/130.32 |
| 6,381,114 | B1 | 4/2002 | Mansfield | |
| 7,006,362 | B2 * | 2/2006 | Mizoguchi | H02M 3/158 323/271 |
| 7,257,009 | B2 * | 8/2007 | Negoi | H02M 7/062 363/59 |
| 2001/0050591 | A1 * | 12/2001 | Sano | G05F 1/565 327/540 |
| 2005/0180077 | A1 * | 8/2005 | Hattori | G05F 1/56 361/103 |
| 2006/0244494 | A1 * | 11/2006 | Cetrulo et al. | 327/103 |
| 2008/0007307 | A1 | 1/2008 | Freiburger et al. | |
| 2008/0088285 | A1 * | 4/2008 | Zhou | G05F 1/56 323/271 |
| 2011/0031943 | A1 * | 2/2011 | Green | H02M 1/4208 323/205 |

FOREIGN PATENT DOCUMENTS

| | | | |
|---|---|---|---|
| DE | 102006024311 | A1 | 11/2007 |
| RU | 2400007 | C1 | 9/2010 |
| WO | WO 01/76037 | | 10/2001 |

OTHER PUBLICATIONS

International Search Report received in International Patent Application No. PCT/EP2011/067871, dated May 4, 2012.

Written Opinion of the International Searching Authority received in International Patent Application No. PCT/EP2011/067871, dated Oct. 13, 2011.

Office Action dated Dec. 11, 2015 in Chinese Application No. 201180049058.X (with English Translation).

"Russian Hamradio," web page <http://www.qrx.narod.ru/izm/pr_mop.htm>, 2 pages, Jan. 1, 2009, retrieved from Internet Archive Wayback Machine <http://web.archive.org/web/20090101045034/http://www.qrx.narod.ru/izm/pr_mop.htm> on Feb. 12, 2015.

* cited by examiner

CURRENT OUTPUT STAGE HAVING AUTOMATIC ACTIVE-PASSIVE SWITCHING

The invention relates to a current output stage having automatic active-passive switching.

Numerous current output stages are known in the prior art. These are generally provided as active current output stages or as passive current output stages.

Figure 1A:
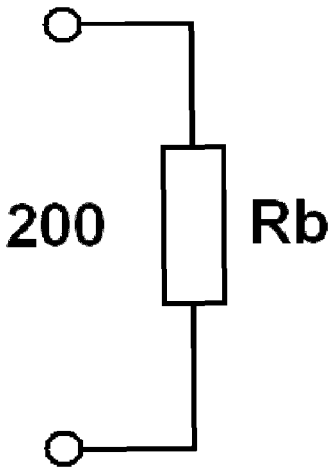

In an active current output stage, the output current is controlled by the current output stage, and the energy for the output current is provided from the current output stage. This active current output stage is suitable for operating a passive receiver—as is illustrated in FIG. 1*a*.

Figure 1B:
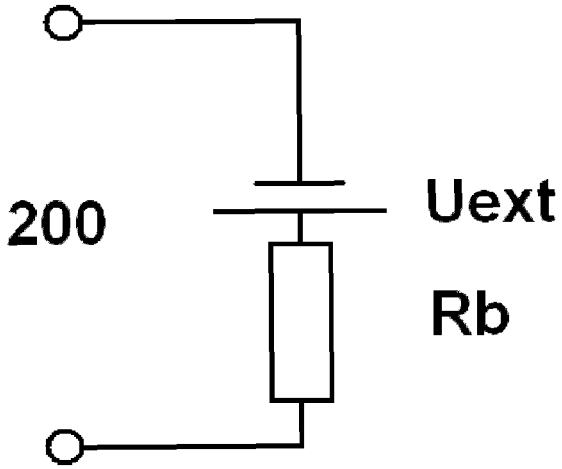

In a passive current output stage, the output current is controlled by the current output stage, and the energy for the output current is provided externally by an active receiver. This passive current output stage is suitable for operating an active receiver—as is illustrated in FIG. 1*b*.

Therefore, when current output stages are used, it is always necessary first to know whether the input to be supplied with current is an active or a passive input.

Improper usages frequently occur, however, because in many cases it is not immediately clear whether the input to be supplied with current is an active or a passive input.

Moreover, the development and stocking of different current output stages for production purposes has proven to be costly.

Although in more recent current output stages the two options are combined, such stages still involve a physical separation into different outputs, so that users must choose the corresponding outputs for use. Such current output stages are used, e.g., in MACX MCR-EX-SL-RPSSI-I-SP signal isolators, which are produced by the applicant. A device of this type is also known from DE 10 2006 024 311.

However, these cases also frequently result in improper usages, since in many cases it is not readily apparent whether the input to be supplied with current is an active or a passive input.

A further drawback of such embodiments is that more connection terminals must be provided, resulting in an increase in the size of the housing, while the general trend is toward a decrease in housing sizes.

In light of the above, the problem addressed by the invention is that of providing a current output stage which solves one or more of the disadvantages known in the prior art in an inventive manner.

The problem is solved by a current output stage which comprises an input and an output for connecting to an input of a unit to be supplied with current. The current output stage further comprises a control stage, which sets the output current, and an energy supply stage, which can provide energy for the output current. The current output stage further comprises a first transistor, which controls the output current in the passive operating mode, and a second transistor, which controls the output current in the active operating mode, wherein the first transistor and the second transistor are controlled by a control stage, and wherein in the active operating mode, the energy supply stage is controlled so as to provide energy for the output current.

The problem is also solved by a current output stage which comprises an input and an output for connecting to an input of a unit to be supplied with current. The current output stage further comprises a control stage, which sets the output current, and an energy supply stage, which can provide energy for the output current. The current output stage has a detection device, which detects at the output whether the current output stage is operating in the passive or the active operating mode, and when active operation is detected (active operating mode), controls the energy supply stage such that it provides energy for the output current, and when passive operation is detected (passive operating mode), the energy for the output current is provided from the input of the unit to be supplied with current.

In further developments of the current output stage, the control stage is a voltage/current transformer or a current/current transformer.

In a further embodiment of the invention, the current output stage is designed for bipolar operation.

In yet another embodiment, the control stage comprises an operation amplifier.

In a further embodiment, the detection device comprises one or more transistors.

In yet another embodiment of the invention, the detection device comprises at least one MOS-FET transistor.

In what follows, the invention will be specified in greater detail in reference to the set of drawings. The drawings show:

FIG. 1*a*: a passive receiver, and FIG. 1*b*: an active receiver.

Figure 2:
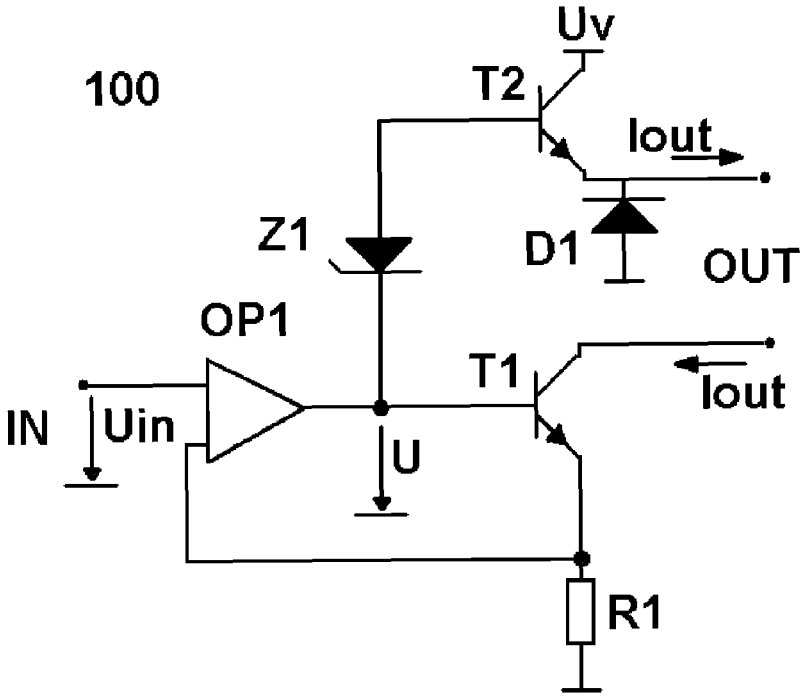

FIG. 2: a wiring variant of a current output stage according to the invention having automatic active-passive switching.

Figure 3:
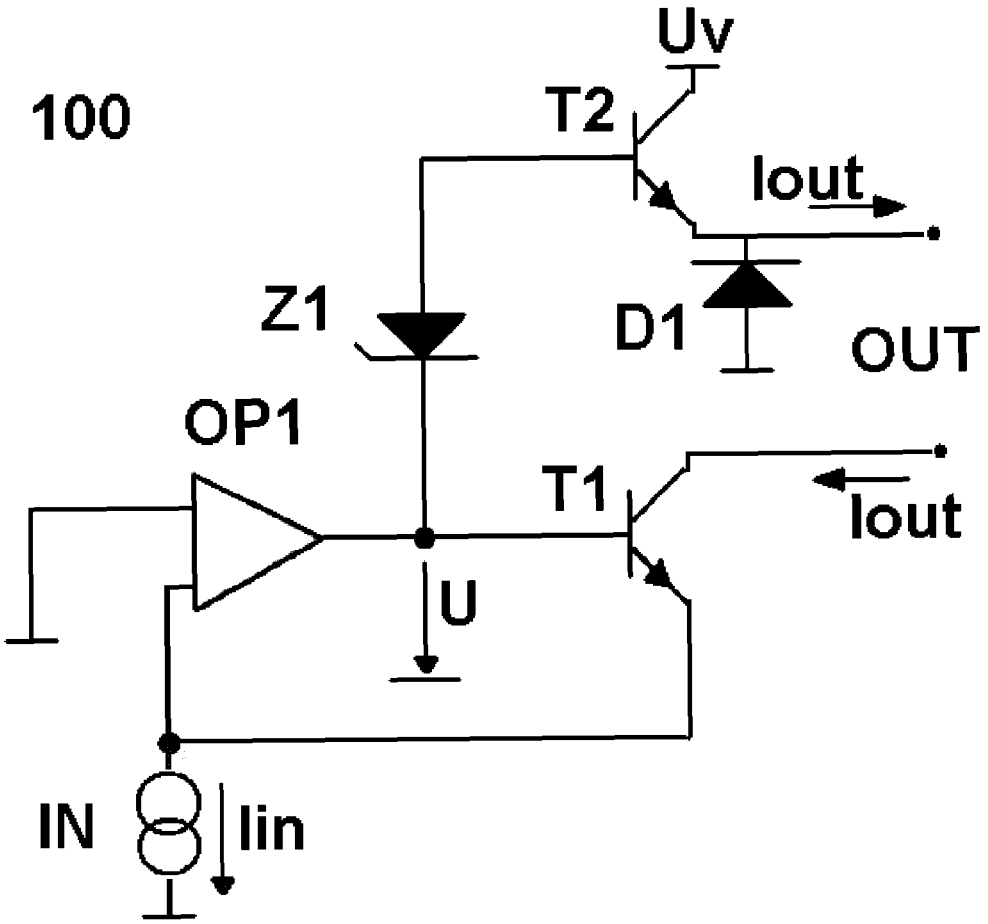
Figure 4:
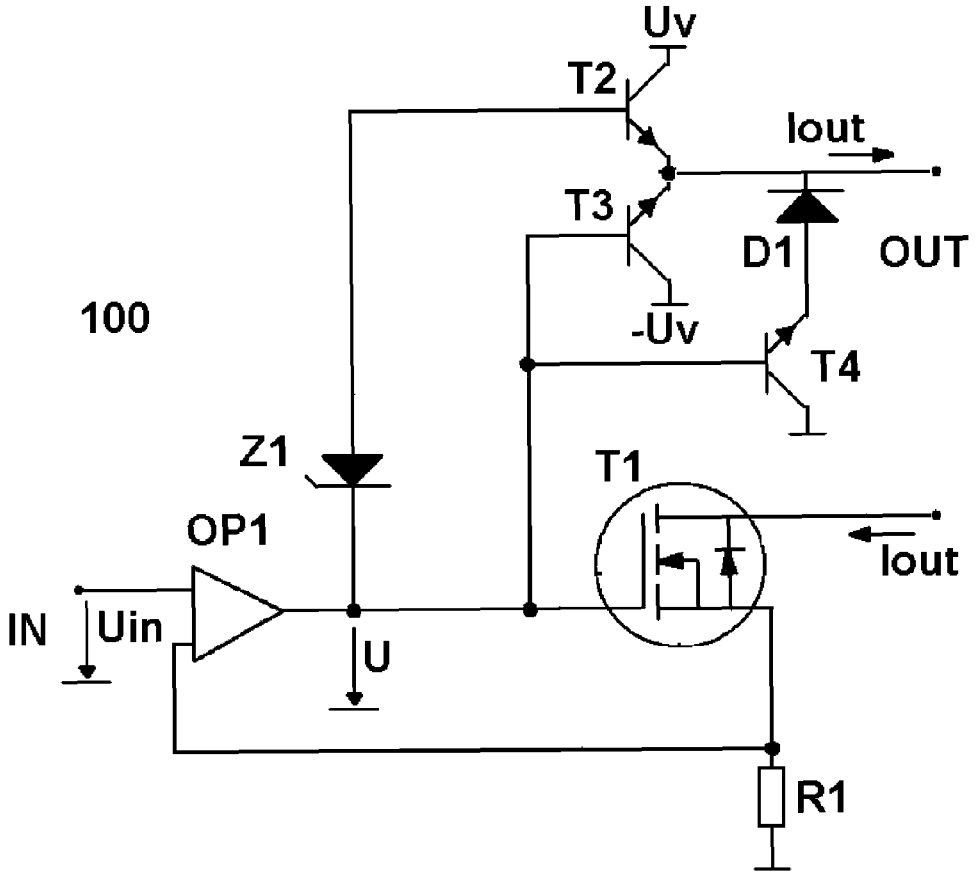

FIG. 3: a further wiring variant of a current output stage according to the invention having automatic active-passive switching, and FIG. 4: yet another wiring variant of a current output stage according to the invention having automatic active-passive switching.

FIG. 2 illustrates an embodiment of a current output stage 100 according to the invention. Said output stage is equipped with an input IN and an output OUT for connecting to an input of a unit 200 to be supplied with current.

This unit 200 to be supplied with current can be embodied as either passive, as shown in FIG. 1*a*, or active, as shown in FIG. 1*b*.

The current output stage 100 further comprises a control stage OP1, which sets the output current, and an energy supply stage Uv, which can provide energy for the output current Iout.

The current output stage 100 further comprises a first transistor T1, which controls the output current Iout in the passive operating mode, and a second transistor T2, which controls the output current Iout in the active operating mode, wherein the first transistor T1 and the second transistor T2 are controlled by the control stage OP1, and wherein in the active operating mode, the energy supply stage Uv is controlled so as to provide energy for the output current Iout.

In other words, the current output stage comprises a detection device T1, T2, Z1, which detects at the output OUT whether the current output stage is in passive or in active operation, and when active operation is detected (active operating mode), controls the energy supply stage Uv such that it provides energy for the output current Iout, and when passive operation is detected (passive operating mode), energy for the output current Iout is provided from the input of the unit 200 to be supplied with current.

In the interest of clarity, the mode of operation will now be specified in greater detail.

When an active unit 200, as illustrated schematically in FIG. 1*b*, is to be connected to the output OUT, the output current Iout flows through the output load Rb of the unit 200, driven by the external voltage source Uext there. From there, the current is conducted via T1, R1 and D1, and thereby again reaches the unit 200. In this case, the output current Iout is set by T1.

In the illustrated embodiment according to FIG. 2, OP1 is part of a voltage-current transformer, and therefore, part of a control stage which sets the current via T1 in proportion to the voltage Uin at input IN.

Since T2 is connected via a Z-diode Z1, this mode of operation results in a blocking of the transistor T2, i.e., no current flows from the energy supply Uv. Therefore, the output current Iout flows via the controlled T1.

If, in turn, a passive unit, as illustrated schematically in FIG. 1*a*, is to be connected to the output OUT, the operation amplifier OP1 will attempt first to set the output current using the transistor T1.

However, because the receiver has no current source, a further opening of the transistor T1 will not result in a current flow Iout because it is also blocked by T2.

To counteract this, the transistor is further actuated, and the output voltage U is increased at the operation amplifier.

If the output voltage U of the operation amplifier OP1 as part of a voltage-current transformer, and therefore a control stage, overcomes the breakdown voltage, or the like, of the Z-diode Z1, shown by way of example, then T2 can take over control of the current from the energy supply stage Uv.

The output current Iout, driven by the energy supply stage Uv, then flows through T2 and then via the output load Rb through the fully through-connected (opened) transistor T1, and via R1 back to the energy supply stage Uv.

It goes without saying that various types of transistors can be used for transistors T1 and T2 shown in the figures, and therefore, the selection is not limited to bipolar transistors, FET or Darlington transistors.

It also goes without saying that T1 and T2 can be of different types, i.e., T1 can be an FET transistor, while T2 is a bipolar transistor.

The embodiment illustrated in FIG. 3 differs essentially from the embodiment of FIG. 2 in that here, instead of a voltage-current transformer as a control stage, a current-current transformer is used as the control stage, as is clear from the different wiring of the operation amplifier OP1.

Moreover, the embodiment illustrated in FIG. 4 enables bipolar operation.

In this case, T2 and T3 form a bipolar output stage, which sets the current similarly to T2 from FIG. 2 and FIG. 3 in the active mode, i.e., for passive unit 200.

T1, in turn, sets the current in the passive mode, i.e., for active unit 200.

T4 represents a switch, which switches diode D1 on during passive operation.

In this connection, the response thresholds for the transistors are selected such that, with negative output voltages U of the operation amplifier OP1, the transistor T3 sets the output current Iout. In this case, the output current Iout, referred to the illustration, is negative.

In this operating mode, T1, T2 and T4 act as blocks.

If, in contrast, T1 sets the output current Iout during passive operation, T4 is conductive and T2 and T3 act as blocks.

If T2 controls the output current Iout during active operation, T1 and T4 are conductive and T3 acts as a block.

The response thresholds in this case are implemented as Z-diodes in the corresponding base or gateway terminals.

With negative output current Iout in the active mode, the diode D1 must be switched off by T4, since otherwise, D1 would short-circuit the negative output current Iout.

Furthermore, in the circuit according to FIG. 4, transistor T1 is embodied as a MOS-FET. The advantage of this is that, due to its technology, the transistor allows passage of the negative output current Iout, since it is inherently equipped with a diode structure. This design-based diode allows the current to pass, even if T1 is blocked in its main direction.

In this case as well, it goes without saying that, rather than the voltage-current transformer, a current-current transformer as shown in FIG. 3 can be used.

LIST OF REFERENCE SIGNS

T1, T2, T3, T4 Transistor
D1 Diode
Z1 Z-diode
OP1 Operation amplifier
IN Input
OUT Output
Iout Output current
Uin Input voltage
Iin Input current
+Uv, −Uv Supply voltage
100 Current output stage
200 Unit to be supplied

The invention claimed is:

1. A current output stage configured to control an output current at first and second current output terminals, wherein the current output stage provides energy for the output current when in an active mode, and wherein an active receiver provides the energy for the output current when in a passive mode, the current output stage comprising:

an operational amplifier comprising a first input, a second input, and an output;

a Zener diode having an input and an output electrically coupled to the output of the operational amplifier;

a first transistor comprising:

a base or gate terminal electrically coupled to the output of the operational amplifier;

a collector or drain terminal electrically coupled to the first output terminal; and an emitter or source terminal electrically coupled to the first input of the operational amplifier; and a second transistor comprising:

a base or gate terminal electrically coupled to the input of the Zener diode;

a collector or drain terminal electrically coupled to a power source; and an emitter or source terminal electrically coupled to the second output terminal.

2. The current output stage according claim 1, further comprising a second diode having an input electrically coupled to ground and an output electrically coupled to the emitter or source of the second transistor.

3. The current output stage according claim 2, further comprising a resistor having a first terminal electrically coupled to ground and a second terminal electrically coupled to the emitter or source of the first transistor.

4. The current output stage according claim 1, further comprising:

a second diode having an input and an output electrically coupled to the emitter or source of the second transistor;

a third transistor comprising:

a base or gate terminal electrically coupled to the output of the operational amplifier;

a collector or drain terminal electrically coupled to a negative power source; and an emitter or source terminal electrically coupled to the second output terminal; and a fourth transistor comprising:

a base or gate terminal electrically coupled to the output of the operational amplifier;

a collector or drain terminal electrically coupled to ground; and an emitter or source terminal electrically coupled to the input of the second diode.

* * * * *